US008851024B2

(12) United States Patent
Wilhelm

(10) Patent No.: US 8,851,024 B2
(45) Date of Patent: Oct. 7, 2014

(54) WATER RESERVOIR FOR A STEAM GENERATION SYSTEM AND METHOD OF USE THEREOF

(75) Inventor: Bruce W. Wilhelm, Enfield, CT (US)

(73) Assignee: ALSTOM Technology Ltd, Baden (CH)

( * ) Notice: Subject to any disclaimer, the term of this patent is extended or adjusted under 35 U.S.C. 154(b) by 372 days.

(21) Appl. No.: 13/313,868

(22) Filed: Dec. 7, 2011

(65) Prior Publication Data

US 2013/0145998 A1 Jun. 13, 2013

(51) Int. Cl.
*F22B 35/02* (2006.01)

(52) U.S. Cl.
USPC ..... 122/488; 122/406.1; 122/492

(58) Field of Classification Search
USPC ..... 122/34, 488, 492, 486, 487, 406.1, 122/19.1, 13.3, 18.5
See application file for complete search history.

(56) References Cited

U.S. PATENT DOCUMENTS

| | | | | |
|---|---|---|---|---|
| 4,207,842 | A * | 6/1980 | Kehlhofer | 122/406.4 |
| 4,745,757 | A * | 5/1988 | Kim | 60/667 |
| 5,326,081 | A * | 7/1994 | Arpalahti | 266/44 |
| 5,727,505 | A * | 3/1998 | Herr et al. | 122/34 |
| 5,762,031 | A * | 6/1998 | Gurevich | 122/7 R |
| 6,155,054 | A * | 12/2000 | Liebig | 60/657 |
| 7,587,996 | B2 * | 9/2009 | Albrecht | 122/406.1 |
| 8,539,750 | B2 * | 9/2013 | Bellows et al. | 60/39.55 |
| 2011/0265444 | A1 * | 11/2011 | Bellows et al. | 60/39.182 |
| 2013/0118477 | A1 * | 5/2013 | Albrecht et al. | 126/609 |

* cited by examiner

*Primary Examiner* — Gregory A Wilson

(57) ABSTRACT

Disclosed herein is a system comprising an evaporator; a water reservoir in fluid communication with the evaporator; the water reservoir being located upstream of the evaporator; and a first steam drum in fluid communication with the evaporator; the first steam drum being located downstream of the evaporator; where the water reservoir is operative to supply feedwater to the evaporator while maintaining a predetermined water level in the first steam drum.

15 Claims, 3 Drawing Sheets

WATER RESERVOIR FOR A STEAM GENERATION SYSTEM AND METHOD OF USE THEREOF

TECHNICAL FIELD

This disclosure relates to a water reservoir for a steam generation system and to methods of use thereof.

BACKGROUND

Drum-type steam generation systems generally comprise three major components: an evaporator, a superheater and an economizer. The different components are put together to meet the operating needs of the unit. Some drum-type steam generation systems may not have a superheater or may include additional components such as reheaters.

The FIG. 1 is a depiction of an exemplary prior art evaporator system 100 of a drum-type steam generator that comprises an evaporator 102 and a steam drum 104. The steam drum 104 is in fluid communication with the evaporator 102. The steam drum 104 is both downstream and upstream of the evaporator 102, i.e., they lie in a recycle loop. In the operation of the evaporator system 100 of the FIG. 1, when the load on the evaporator 102 changes more water is drawn from the steam drum 104. For example, if there is a need for a greater amount of steam than that which was previously desired, the water level in the steam drum 104 drops. Feed water is then introduced to the steam drum 104 to maintain the predetermined operating water levels.

The steam drum 104 is therefore sized based on the steam needs for the drum-type steam generator. However, when additional requirements such as the water hold time exceeds the normal steam drum 104 water storage level for a single drum, it is desirable to increase the size of the steam drum 104. The water hold time (also sometimes termed the "holdup time") is based on the measured liquid volume between normal water level (NWL) and the lowest (also sometimes referred to as the "lo-lo") water level trip. The lowest water trip level is the minimum level at which there will be no danger of overheating any part of the steam generator during operation. This lowest water level is generally about 30 centimeters (about 1 foot) above the bottom of the drum, but varies according to drum diameter.

The normal water level is set below the high water level, as needed for water level measurement accuracy, margin to control feedwater flow and steam purity. In general, the location of normal water level results in about 15 seconds to 30 seconds of water volume (depending upon the flow rate) between the normal water level and the water level trip. The volume of water contained in the drum at these different heights can be calculated using simple formulas for the area of a circular segment.

One manner of increasing the water hold time of a single steam drum is to increase the length and/or the diameter of the drum. However, this may not be a viable option where space availability is limited. The use of larger diameter drums increases shell wall thicknesses to accommodate internal pressures. Thicker walled vessels however generally use longer heat up times when compared with thinner walled vessels resulting slower transient during start-up and/or load changes.

It is therefore desirable to increase the water hold time of the steam drum without incurring additional costs associated with increasing space or with increasing the wall thickness.

SUMMARY

Disclosed herein is a system comprising an evaporator; a water reservoir in fluid communication with the evaporator; the water reservoir being located upstream of the evaporator; and a first steam drum in fluid communication with the evaporator; the first steam drum being located downstream of the evaporator; where the water reservoir is operative to supply feedwater to the evaporator while maintaining a predetermined water level in the first steam drum.

Disclosed herein too is a method comprising discharging feed water from a water reservoir to an evaporator; where the water reservoir lies upstream of the evaporator and is in fluid communication with the evaporator; and discharging water and steam from the evaporator to a first steam drum; where the evaporator lies upstream of the first steam drum and in fluid communication with the first steam drum; where an amount of water discharged from the water reservoir to the evaporator is effective to increase the water level in the first steam drum to a desired level.

DETAILED DESCRIPTION

Disclosed herein is an evaporator system that comprises an evaporator, a steam drum and a reservoir. The reservoir is used for holding additional water that is supplied to the evaporator and allows for an increase in the water hold time in the system. Disclosed herein too is a method of increasing the water hold time by providing a water reservoir, which holds water that is supplied to the evaporator when the water level in the steam drum decreases from the normal level. The normal level will hereinafter be referred to as a predetermined level. The evaporator system disclosed herein may be part of a drum-type steam generation system with natural or forced circulation such as heat recovery generation system, steam generation solar receivers, fossil fuel fired steam generation systems and other systems where an increase in the volume of the steam drum is desired to increase water hold up time, but where there are space limitations.

Figure 1:
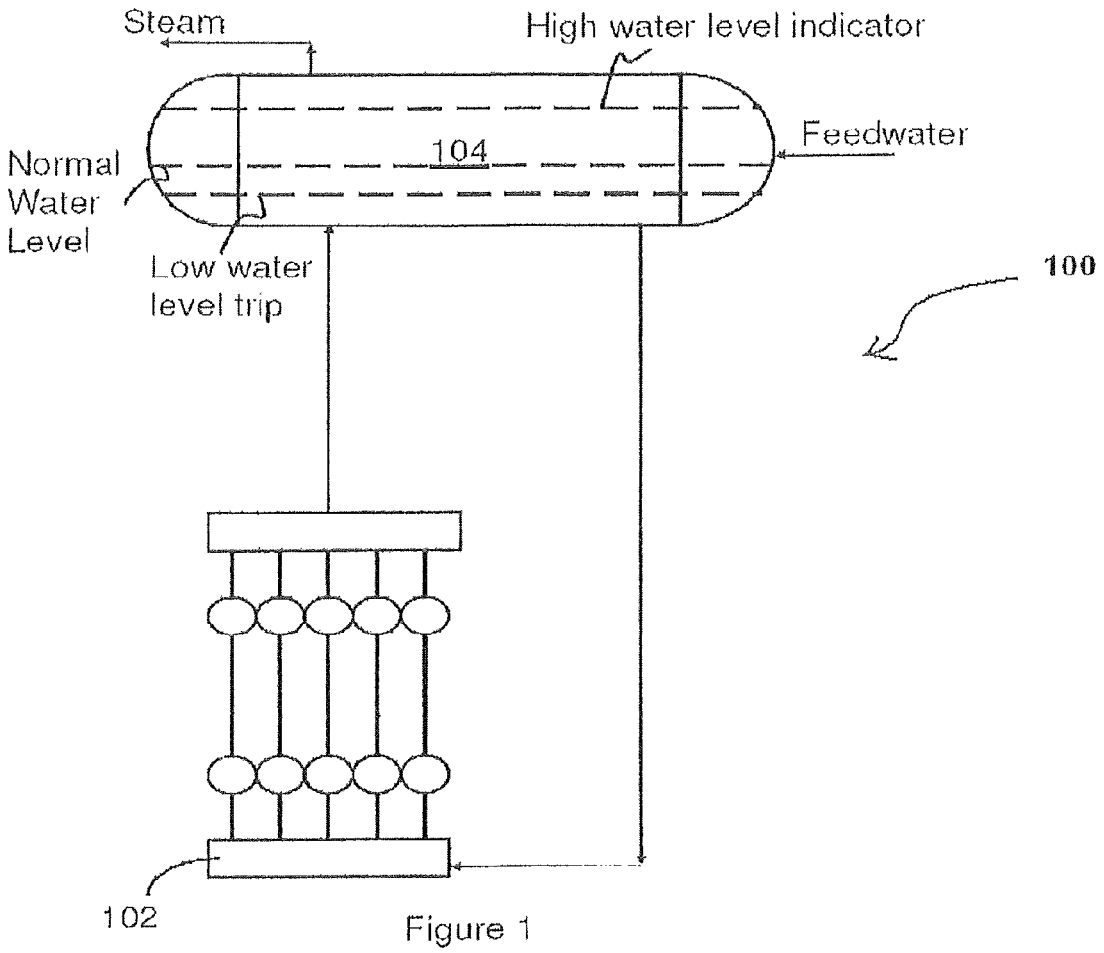
FIG. 1 is a depiction of an exemplary prior art evaporator system that comprises an evaporator and a steam drum.
Figure 2:
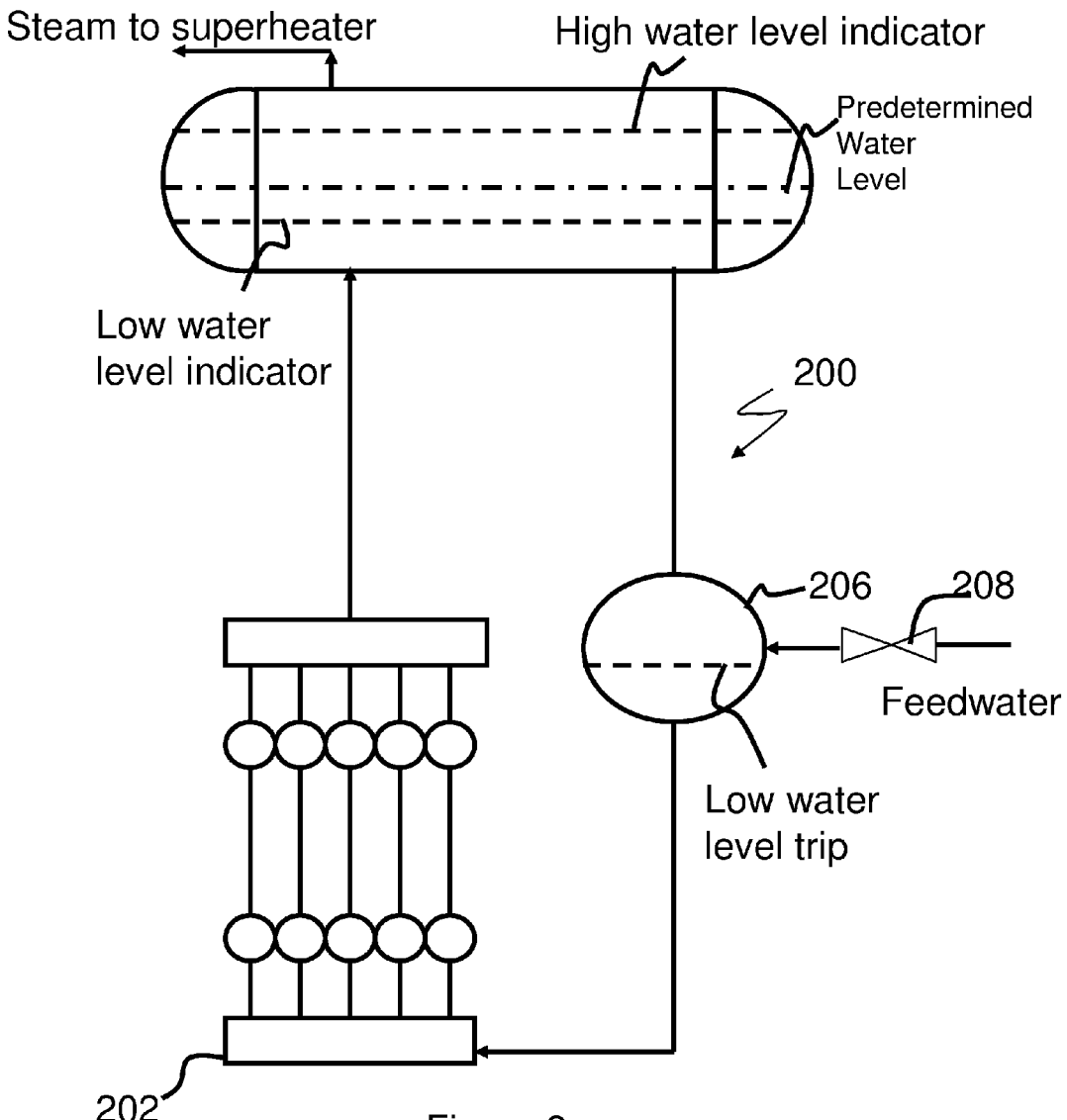
FIG. 2 depicts an exemplary system that comprises an evaporator, a steam drum and a water reservoir that are in fluid communication with one another.

FIG. 2 depicts a system 200 that comprises an evaporator 202, a steam drum 204 and a water reservoir 206 that are in fluid communication with one another. The evaporator 202 is disposed upstream of the steam drum 204 and downstream of the water reservoir 206. Feed water is fed into the water reservoir 206 via a valve 208. In one embodiment, the valve 208 is a flow control valve. The water from the water reservoir 206 is fed to the evaporator 202, where it is converted into steam and water. The water and steam are then fed from the evaporator 202 into the steam drum 204, where the steam is separated from the water. The steam is discharged to a superheater or to a turbine to generate energy, while the water in the steam drum 204 is recycled to the water reservoir 206 where it mixes with the feed water before being fed to the evaporator 202.

Both the steam drum 204 and the water reservoir 206 are equipped with level sensors to detect when desired liquid levels (e.g., water levels) deviate from desired values. The steam drum 204 comprises a first water level indicator, which is activated when the water level increases above a certain level (e.g., a high water level indicator), drops below a certain desired level (e.g., a low water level indicator) and control the feed water to the reservoir to maintain the predetermined water level. The predetermined water level lies between the high water level and the low water level. The water reservoir 206 also comprises a second water level indicator, which is activated when the water level decreases below a certain desired level (e.g., a low water level trip). The water level indicators may be floats, a manometer (e.g., a distilled water column or a mercury column), conductivity probes or the like, or a combination thereof.

In one embodiment, in one method of operating the evaporation system 200 of the FIG. 2, when the demand or load on the evaporator 202 changes such that the ratio of steam to water generated in the evaporator 202 is increased, the level of water in the steam drum 204 may decrease below the desired level. When the water level decreases below the predetermined level as indicated by the water level indicator, feed water flow to the water reservoir is increased. The increased water flow from the water reservoir 206 is introduced into the evaporator 202 to comply with the requirement for additional steam, while at the same time compensating for the loss of water from the steam drum 204. On the other hand, when the water level in the steam drum 204 increases above the desired level, feed water flow to the water reservoir is decreased. The reduced water flow from the water reservoir 206 is introduced into the evaporator 202 to comply with the requirement for a lower rate of steam-water flow into the steam drum 204. In one embodiment, when the water level in the water reservoir 206 decreases below the predetermined level, water is fed into the water reservoir 206 via the valve 208 to maintain the water level to the predetermined level.

The presence of the water reservoir 206 in the evaporation system 200 can thus be used to minimize space requirements in at least one direction. In one embodiment, the system comprising the water reservoir is shorter than an equivalent system that does not contain the water reservoir when both systems utilize an equivalent drum diameter, hold up time and produce an equivalent amount of steam.

If the evaporation system 200 were devoid of the water reservoir 206, the steam drum 204 would have to be longer, which depending on the arrangement may be difficult to fit into a confined space or the diameter would have to be increased. In addition, as drum diameter increases the thickness of the walls of the steam drum 204 would have to be increased to the point where the stresses in these walls would increase significantly. The use of a water reservoir 206 prevents these problems.

Figure 3:
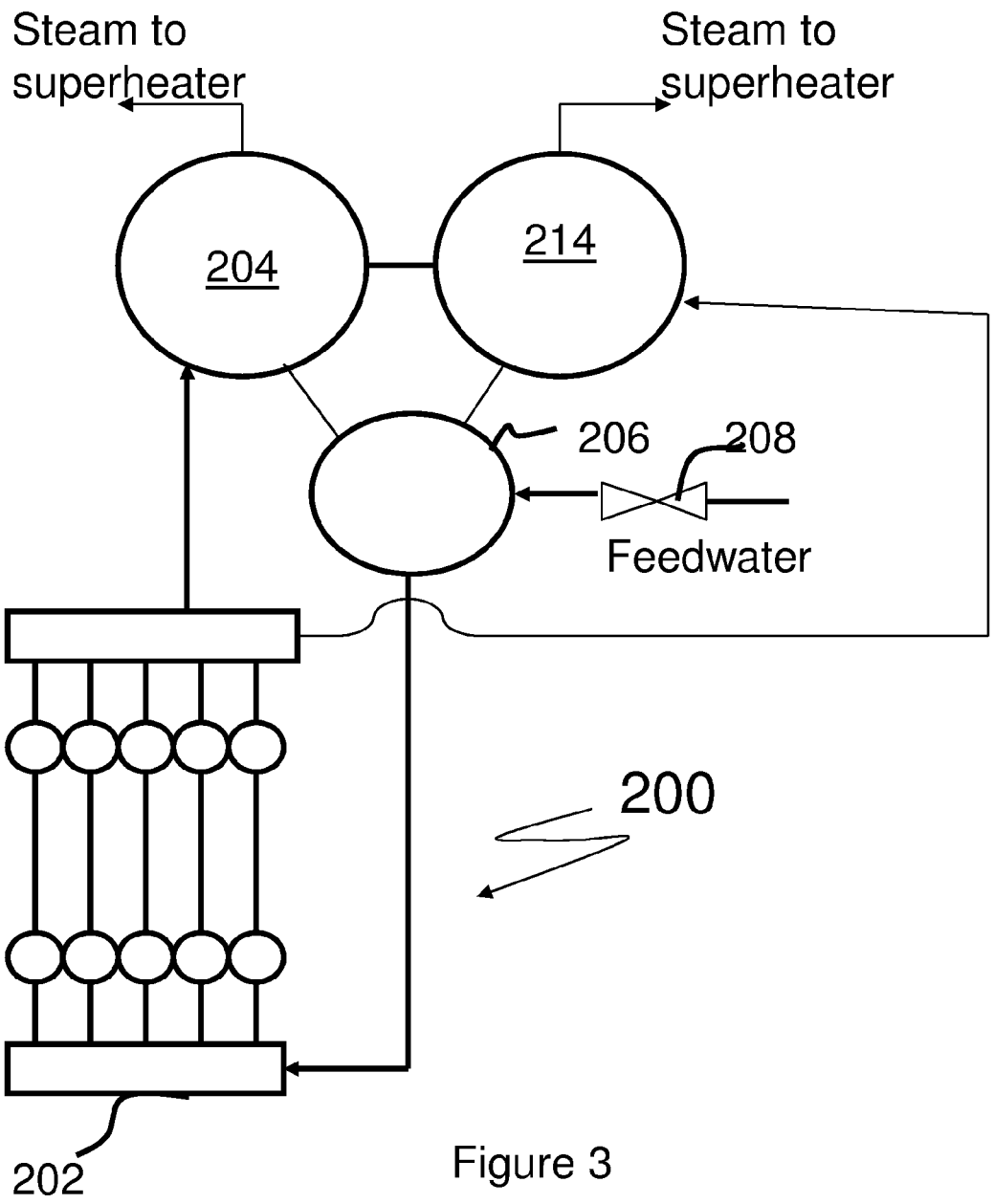
FIG. 3 depicts an exemplary system that comprises an evaporator, two steam drums and a water reservoir that are in fluid communication with one another.

In another embodiment depicted in the FIG. 3, the evaporation system 200 comprises two steam drums—a first steam drum 204 and a second steam drum 214 in fluid communication with the water reservoir 206 and the evaporator 202. The first steam drum 204 and the second steam drum 214 may be in fluid communication with one another. Steam and water from the evaporator 202 can be discharged to the first steam drum 204 and to the second steam drum 214. In one embodiment, water and steam from the first steam drum 204 can be discharged to the second steam drum 214. In another embodiment, water and steam from the second steam drum 214 can be discharged to the first steam drum 204.

While the FIG. 3 depicts two steam drums 204 and 214, the system can have more than two drums. In other words, the evaporation system 200 may comprise a plurality of steam drums in fluid communication with the water reservoir 206 and the evaporator 202. By using two steam drums 204 and 214, the length and size of the steam drums can further be minimized. The two steam drums 204 and 214 function in conjunction with the water reservoir 206 and the evaporator 202 in the same manner as the single steam drum 204 in the FIG. 2.

When the water level decreases below the desired level as indicated by the water level indicator, water from the water reservoir 206 is introduced into the evaporator 202 to comply with the requirement for additional steam, while at the same time compensating for the loss of water in the steam drum 204 or the steam drum 214. If the level of water in the steam drums 204 or 214 decreases below the desired level then additional feedwater is supplied to the water reservoir 206 via the valve 208.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

While the invention has been described with reference to a preferred embodiment and various alternative embodiments, it will be understood by those skilled in the art that changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system comprising:

an evaporator;

a water reservoir in fluid communication with the evaporator and directly upstream of the evaporator for direct discharge of a fluid to the evaporator; and a first steam drum downstream of the evaporator, in fluid communication with the evaporator for a fluid supply therefrom, and upstream of the water reservoir in fluid communication with the water reservoir for a fluid supply thereto, with the water reservoir operative to supply feedwater to the evaporator while maintaining a predetermined water level in the first steam drum.

2. The system of claim 1, wherein saturated water from the first steam drum is mixed with feed water in the water reservoir.

3. The system of claim 1, wherein the first steam drum is in fluid communication with the water reservoir and is equipped with a first water level indicator.

4. The system of claim 1, wherein the first steam drum comprises a first water level indicator; the first water level indicator being operative to shut off the flow of feed water from the water reservoir to the evaporator when the water level in the first steam drum exceeds a desired level.

5. The system of claim 1, wherein the steam drum comprises a second water level indicator; the second water level indicator being operative to facilitate the flow of feed water from the water reservoir to the evaporator when the water level in the steam drum is reduced below the desired level.

6. The system of claim 1, wherein the water reservoir comprises a water level indicator; the water level indicator being operative to stop heat input to the steam generator to protect the system from overheating.

7. The system of claim 1, wherein the first steam drum is shorter than a steam drum of a system not equipped with a water reservoir when both steam drums utilize an equivalent drum diameter, hold up time and produce an equivalent amount of steam.

8. The system of claim 1, further comprising a second steam drum; wherein the second steam drum is in fluid communication with the water reservoir to provide fluid thereto.

9. The system of claim 8, wherein the second steam drum is in fluid communication with the evaporator to receive fluid therefrom.

10. The system of claim 9, wherein the second steam drum is in direct fluid communication with the water reservoir.

11. A method comprising:

discharging feed water from a water reservoir to an evaporator; where the water reservoir is directly upstream of the evaporator and is in direct fluid communication with the evaporator; and discharging water and steam from the evaporator to a first steam drum; wherein the evaporator is upstream of the first steam drum and in fluid communication with the first steam drum; and wherein an amount of water discharged from the water reservoir to the evaporator is effective to increase the water level in the first steam drum to a desired level.

12. The method of claim 11, wherein the discharging the feed water from the reservoir to the evaporator occurs when the load on the evaporator changes to produce an increased or decreased ratio of steam to water.

13. The method of claim 11, further comprising discharging water and steam from the evaporator to the second steam drum.

14. The method of claim 11, further comprising discharging water and steam from the first steam drum to the second steam drum.

15. The method of claim 11, further comprising discharging water and steam from the second steam drum to the first steam drum.

* * * * *